US010424194B2

(12) United States Patent
Jung et al.

(10) Patent No.: US 10,424,194 B2
(45) Date of Patent: Sep. 24, 2019

(54) PEDESTRIAN PROTECTION SYSTEM USING BEACON SIGNAL

(71) Applicant: PASSNET CO., LTD., Gyeonggi-do (KR)

(72) Inventors: Jung Hoon Jung, Gyeonggi-do (KR); Kyun-Ork Park, Gyeonggi-do (KR)

(73) Assignee: PASSNET CO., LTD., Gyeonggi-Do (KR)

( * ) Notice: Subject to any disclaimer, the term of this patent is extended or adjusted under 35 U.S.C. 154(b) by 0 days.

(21) Appl. No.: 16/136,809

(22) Filed: Sep. 20, 2018

(65) Prior Publication Data

US 2019/0088112 A1 Mar. 21, 2019

(30) Foreign Application Priority Data

Sep. 21, 2017 (KR) ..... 10-2017-0121691

(51) Int. Cl.

| | |
|---|---|
| ***G08G 1/005*** | (2006.01) |
| ***G08B 3/10*** | (2006.01) |
| ***E01F 15/00*** | (2006.01) |
| ***G08G 1/095*** | (2006.01) |
| ***G08G 1/01*** | (2006.01) |

(Continued)

(52) U.S. Cl.

CPC ..... *G08G 1/005* (2013.01); *E01F 15/003* (2013.01); *G08B 3/10* (2013.01); *G08G 1/0112* (2013.01); *G08G 1/0116* (2013.01); *G08G 1/095* (2013.01); *G08G 1/163* (2013.01); *G08G 1/166* (2013.01); *G08G 1/0175* (2013.01)

(58) Field of Classification Search

None

See application file for complete search history.

(56) References Cited

U.S. PATENT DOCUMENTS 5,070,334 A * 12/1991 Commissaire ..... G01S 7/023 342/125
9,989,966 B2 * 6/2018 Wei ..... B60W 30/00
10,118,548 B1 * 11/2018 Fields ..... B60Q 5/005

(Continued)

FOREIGN PATENT DOCUMENTS

KR 1020110127520 11/2011
KR 101433649 8/2014

(Continued)

*Primary Examiner* — Curtis J King

(74) *Attorney, Agent, or Firm* — IPLA P.A.; James E. Bame

(57) ABSTRACT

A pedestrian protection system using a beacon signal includes a beacon device mounted on a vehicle to transmit a beacon signal, a beacon signal receiver configured to receive the beacon signal transmitted by the beacon device of the vehicle, bollard devices disposed adjacent to one side of a crosswalk toward a sidewalk where a person waits to cross a street at the crosswalk, a pedestrian display device, a lighting device configured to brighten the crosswalk or the sidewalk, a speaker configured to notify the pedestrian or the waiting pedestrian of the approaching of the vehicle, and a controller configured to identify the approaching of the vehicle based on the beacon signal received from the beacon signal receiver, to receive information about the pedestrian or waiting pedestrian from the bollard device, and to control operations of the pedestrian display device and the lighting device.

6 Claims, 5 Drawing Sheets

(51) Int. Cl.
*G08G 1/16* (2006.01)
*G08G 1/017* (2006.01)

(56) References Cited

U.S. PATENT DOCUMENTS

| | | | | |
|---|---|---|---|---|
| 2009/0002197 | A1* | 1/2009 | Cemper | G08B 21/0247 340/989 |
| 2009/0146841 | A1* | 6/2009 | Basson | G08G 1/005 340/925 |
| 2010/0100324 | A1* | 4/2010 | Caminiti | G08G 1/0104 701/301 |
| 2014/0267398 | A1* | 9/2014 | Beckwith | G08G 1/166 345/633 |
| 2016/0071413 | A1* | 3/2016 | Jones | G08G 1/0955 340/907 |
| 2016/0328959 | A1* | 11/2016 | Liu | G06O 50/265 |
| 2017/0227964 | A1* | 8/2017 | Lehtiniemi | B60W 30/09 |
| 2018/0012492 | A1* | 1/2018 | Baldwin | B60T 7/00 |
| 2018/0158329 | A1* | 6/2018 | Benhammou | B60T 7/18 |
| 2019/0031198 | A1* | 1/2019 | Aoki | B60W 40/02 |
| 2019/0033876 | A1* | 1/2019 | Aoki | B60W 30/095 |
| 2019/0051150 | A1* | 2/2019 | Anderson | G08G 1/005 |

FOREIGN PATENT DOCUMENTS

| | | |
|---|---|---|
| KR | 1020160113766 | 10/2016 |
| KR | 101739988 | 5/2017 |

* cited by examiner

PEDESTRIAN PROTECTION SYSTEM USING BEACON SIGNAL

CROSS REFERENCE

The present application claims the benefit of Korean Patent Application No. 10-2017-0121691 filed in the Korean Intellectual Property Office on Sep. 21, 2017, the entire contents of which are incorporated herein by reference.

BACKGROUND

The present invention relates to a pedestrian protection system using a beacon signal, which can prevent an accident at a crosswalk by detecting a vehicle approaching a crosswalk by recognizing a beacon signal transmitted by a beacon device mounted on the vehicle, notifying a pedestrian who crosses the street at the crosswalk or a waiting pedestrian of whether the vehicle approaches, and simultaneously enabling the driver of the vehicle to confirm the presence of the pedestrian or the waiting pedestrian.

In general, traffic lights for controlling the crossing of a pedestrian are disposed in a road where a crosswalk has been installed. Traffic lights in a suburb road are changed into a flickering state at night, and such a road corresponds to a road not having a traffic light. In a road where a crosswalk has been installed, but a traffic light is not present or a road where traffic lights are changed into a flickering state at night, in order for a pedestrian to cross the road using the crosswalk, the pedestrian must identify a vehicle that enters the crosswalk. Furthermore, the driver of the vehicle must identify the presence of a pedestrian at the crosswalk before he or she enters the crosswalk.

In order to solve such a problem, in Korean Patent No. 10-1433649, the speed of a vehicle that enters a crosswalk is measured using a vehicle speed sensor, and a pedestrian is notified of the approaching of the vehicle.

In Korean Patent No. 10-1433649, however, the vehicle speed sensor uses ultrasonic waves from a sidewalk to a carriageway. Accordingly, there is a problem in that the time taken for a pedestrian using a crosswalk to handle a situation is short because the distance where a vehicle is recognized is short, that is, 30~40 m.

Accordingly, there is a need for the development of a system, which can secure a sufficient distance where a pedestrian who crosses the street at a crosswalk or a waiting pedestrian can identify whether a vehicle has entered the crosswalk and handle a situation and the driver of the vehicle can also identify the pedestrian and drive safely.

SUMMARY OF THE INVENTION

The present invention provides a pedestrian protection system using a beacon signal, which can prevent an accident at a crosswalk by detecting a vehicle approaching a crosswalk by recognizing a beacon signal transmitted by a beacon device mounted on the vehicle, notifying a pedestrian who crosses the street at the crosswalk or a waiting pedestrian of whether the vehicle approaches, and simultaneously enabling the driver of the vehicle to confirm the presence of the pedestrian or the waiting pedestrian.

A pedestrian protection system using a beacon signal according to an embodiment of the present invention includes a beacon device 10 mounted on a vehicle to transmit a beacon signal, a beacon signal receiver 100 configured to receive the beacon signal transmitted by the beacon device 10 of the vehicle, bollard devices 200 disposed adjacent to one side of a crosswalk toward a sidewalk where a person waits to cross a street at the crosswalk in such a way as to face each other and configured to detect a pedestrian who enters the crosswalk or a waiting pedestrian waiting at the sidewalk, a pedestrian display device 300 configured to display the pedestrian or the waiting pedestrian so that the driver of the vehicle can identify he pedestrian or waiting pedestrian, a lighting device 400 configured to brighten the crosswalk or the sidewalk, a speaker 500 configured to notify the pedestrian or the waiting pedestrian of the approaching of the vehicle, and a controller 700 configured to identify the approaching of the vehicle based on the beacon signal received from the beacon signal receiver 100, to receive information about the pedestrian or waiting pedestrian from the bollard device 200, and to control operations of the pedestrian display device 300 and the lighting device 400.

The beacon device 10 has a transmission distance of 60 m~70 m so that the vehicle can be identified in the crosswalk ahead.

The bollard device 200 includes a pedestrian identification sensor 210 configured to include a first pedestrian identification sensor 211 having a first light-emitting unit and a first light-receiving unit and a second pedestrian identification sensor 212 having a second light-emitting unit and a second light-receiving unit and horizontally spaced apart from the first pedestrian identification sensor 211 and installed on the body of the bollard device to detect a pedestrian who enters the crosswalk from the sidewalk and a pedestrian who enters the sidewalk from the crosswalk, a waiting pedestrian identification sensor 220 installed on the body of the bollard device to identify whether a waiting pedestrian is present in the sidewalk adjacent to the crosswalk, and a sensor operation controller 240 configured to drive the pedestrian identification sensor 210 and waiting pedestrian identification sensor 220 or stop operations of the pedestrian identification sensor 210 and waiting pedestrian identification sensor 220 in response to an operation signal received from the controller 700.

The pedestrian protection system further includes a camera device 600 configured to photograph an image including a bollard device 200 disposed in the sidewalk adjacent to the crosswalk and to store the photographed image when an impact detection signal is received from the bollard device 200. The bollard device 200 further includes an impact detector 230 configured to generate an impact detection signal when the body of the bollard device is inclined at a specific level or more due to an impact through a tilt sensor and to provide the impact detection signal to the camera device 600 or configured to generate an impact detection signal when an impact of a specific level or more is applied to the body of the bollard device 200 and to provide the impact detection signal to the camera device 600.

The controller 700 includes a beacon signal identification unit 710 configured to receive information about the reception of the beacon signal from the beacon signal receiver 100, a pedestrian identification unit 720 configured to receive first and second sensing signals from the first and second pedestrian identification sensors 211 and 212 of the bollard device 200 and to identify whether a pedestrian who crosses the street at the crosswalk by calculating the number of pedestrians who have entered the crosswalk from the sidewalk and the number of pedestrians who have entered the sidewalk from the crosswalk, a waiting pedestrian identification unit 730 configured to identify whether a waiting pedestrian is present in the sidewalk adjacent to the crosswalk based on a sensing signal received from the waiting pedestrian identification sensor 220 of the bollard device 200, a pedestrian display device operation unit 740 configured to turn on the pedestrian display device 300 of a lights-out state so that the driver of the vehicle approaching the crosswalk is capable of identifying a pedestrian who crosses the street at the crosswalk or a waiting pedestrian in the sidewalk adjacent to the crosswalk when a beacon signal is received and the presence of the pedestrian or waiting pedestrian is identified, a vehicle approaching warning unit 750 configured to notify the pedestrian or waiting pedestrian of the approaching of the vehicle through the speaker 500 when the beacon signal is received, a light operation unit 760 configured to turn on the light device 400 of a lights-out state so that the light device brightens the pedestrian or the waiting pedestrian when the beacon signal is received, and a device operation controller 770 configured to provide an operation signal when the beacon signal receiver 100 or the bollard device 200 is driven and to provide a release signal when an operation of the beacon signal receiver 100 or the bollard device 200 is stopped.

The lighting device 400 includes a first light 410 configured to brighten the crosswalk and a second light 420 configured to brighten the sidewalk. The light operation unit 760 of the controller 700 turns on the first light 410 when a beacon signal is received and a pedestrian who crosses the street at the crosswalk is present and turns on the second light 420 when a waiting pedestrian is present.

The speaker 500 includes a first speaker 510 configured to generate a warning sound with respect to a pedestrian at the crosswalk and a second speaker 520 configured to generate a warning sound with respect to a waiting pedestrian near the crosswalk. The vehicle approaching warning unit 750 of the controller 700 includes a first vehicle warning unit 751 configured to generate a voice, warning the approaching of the vehicle, with respect to a pedestrian when a beacon signal is received and the pedestrian is identified to be present in the crosswalk and a second vehicle warning unit 752 configured to generate a voice, cautioning against the approaching of the vehicle, with respect to a waiting pedestrian when a beacon signal is received and the waiting pedestrian is identified to be present in the sidewalk adjacent to the crosswalk.

DESCRIPTION OF REFERENCE NUMERALS OF PRINCIPAL ELEMENTS IN THE DRAWINGS

| | |
|---|---|
| 10: beacon device | 100: beacon signal receiver |
| 200: bollard device | |

-continued

| | |
|---|---|
| 210: pedestrian identification sensor | |
| 211: first pedestrian identification sensor | |
| 212: second pedestrian identification sensor | |
| 220: waiting pedestrian identification sensor | |
| 230: impact detector | |
| 240: sensor operation controller | |
| 300: pedestrian display device | |
| 400: lighting device | 410: first light |
| 420: second light | 500: speaker |
| 510: first speaker | 520: second speaker |
| 600: camera device | 700: controller |
| 710: beacon signal identification unit | |
| 720: pedestrian identification unit | |
| 730: waiting pedestrian identification unit | |
| 740: pedestrian display device operation unit | |
| 750: vehicle approaching warning unit | |
| 751: first vehicle warning unit | |
| 752: second vehicle warning unit | |
| 760: light operation unit | |
| 770: device operation controller | |

DETAILED DESCRIPTION OF THE INVENTION

Hereinafter, embodiments of the present invention are described in detail with reference to the accompanying drawings.

Figure 1:
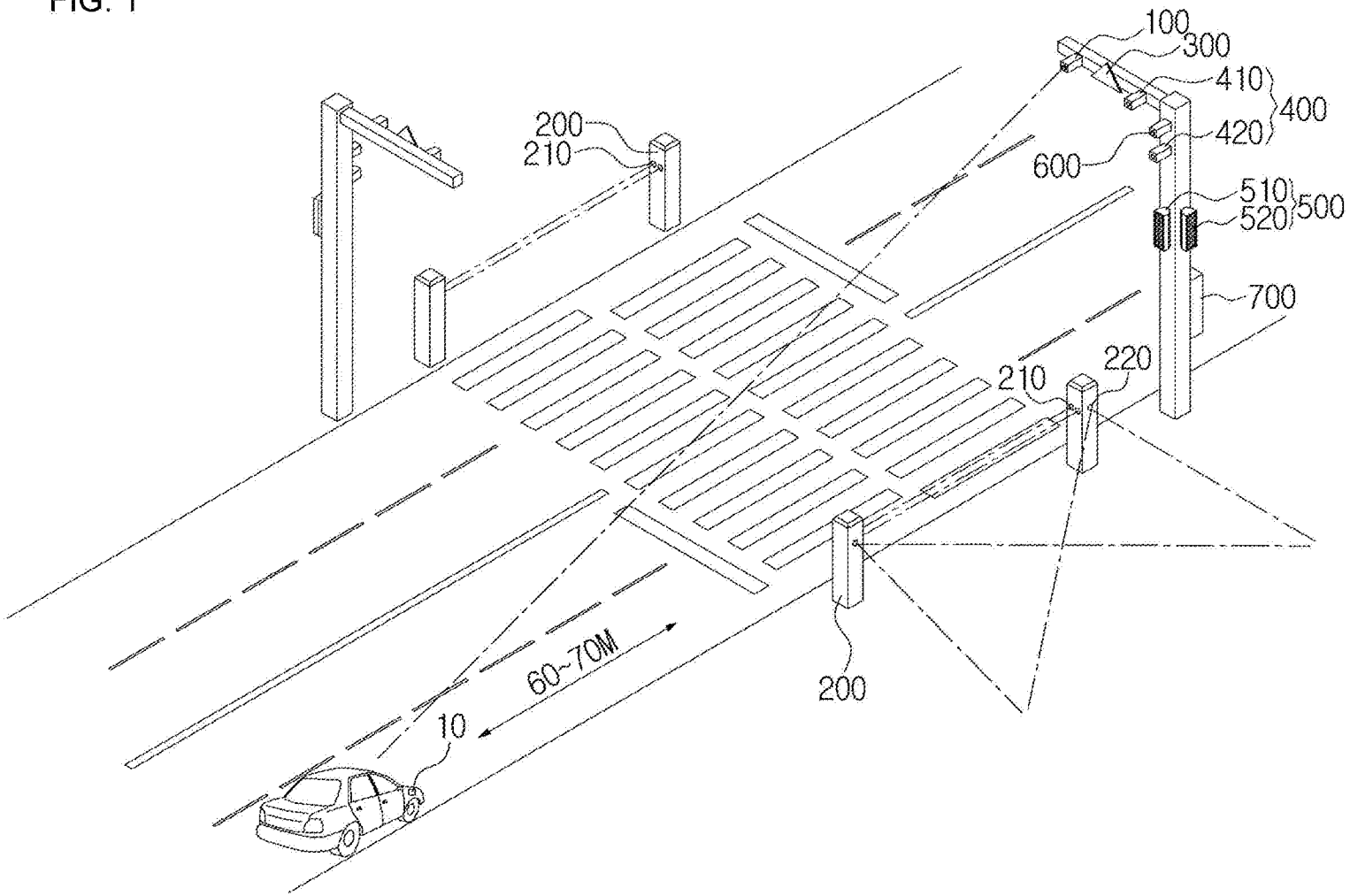
FIG. 1 is a schematic diagram of a pedestrian protection system using a beacon signal according to an embodiment of the present invention.
Figure 2:
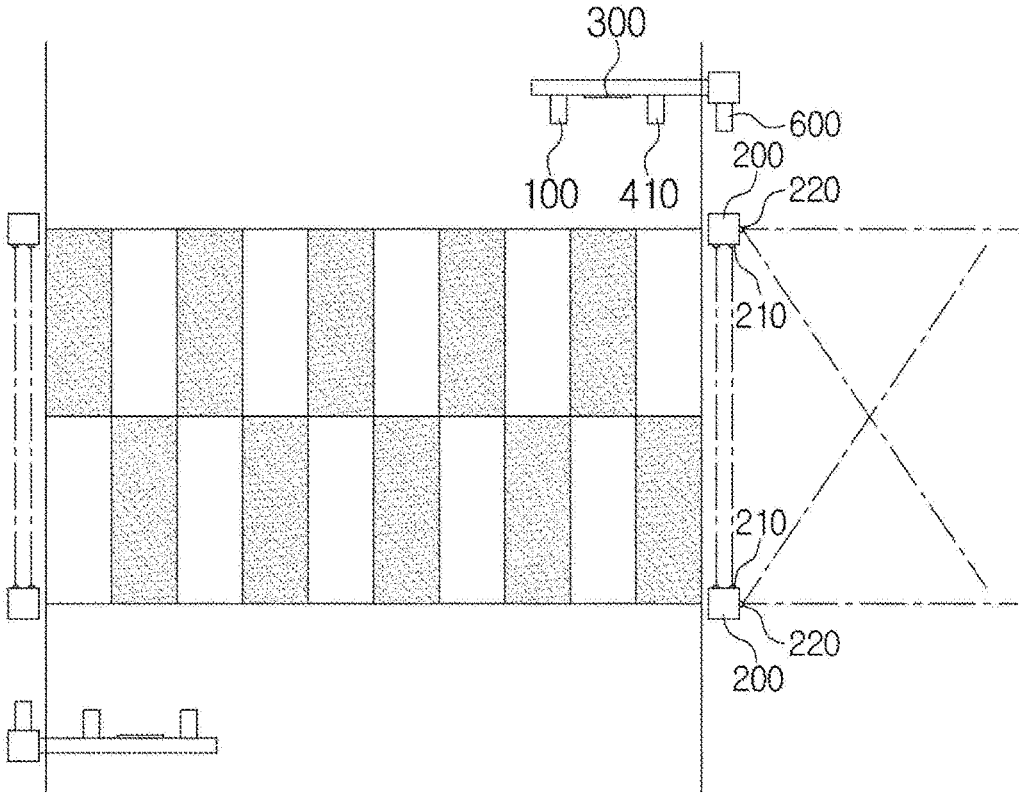
FIG. 2 is a block diagram of a pedestrian protection system using a beacon signal according to an embodiment of the present invention.

As shown in FIGS. 1 and 2, a pedestrian protection system using a beacon signal according to an embodiment of the present invention includes a beacon device 10 mounted on a vehicle to transmit a beacon signal, a beacon signal receiver 100 configured to receive a beacon signal transmitted by the beacon device 10 of a vehicle, bollard devices 200 configured to detect a pedestrian who enters a crosswalk or a waiting pedestrian waiting at a sidewalk, a pedestrian display device 300 configured to display a pedestrian or a waiting pedestrian so that the driver of a vehicle can identify the pedestrian or waiting pedestrian, a lighting device 400 configured to brighten a crosswalk or a sidewalk, a speaker 500 configured to notify a pedestrian or waiting pedestrian of the approaching of a vehicle, a camera device 600 configured to photograph a bollard, and a controller 700 configured to identify the approaching of a vehicle based on a beacon signal and to control the operations of various devices. The beacon signal receiver 100, pedestrian display device 300, lighting device 400, speaker 500, camera device 600, and controller 700 are installed on a fixed pillar disposed in a sidewalk adjacent to a crosswalk and extended to the street at the crosswalk in the case of the crosswalk not having a traffic light, and they are installed on a traffic light pillar in the case of a crosswalk having a traffic light.

The beacon device 10 is installed on a vehicle and transmits a beacon signal toward the direction where a vehicle moves. The beacon device 10 may have a transmission distance of about 60~70 m so that a vehicle can be identified at a crosswalk ahead of the vehicle. The beacon device 10 transmits a beacon signal using a communication method, such as Bluetooth Low Energy (BLE) or Wi-Fi.

The beacon signal receiver 100 receives a beacon signal transmitted by the beacon device of a vehicle that enters a crosswalk and provides the received beacon signal to the controller 700. The beacon signal receiver 100 may operate at sunset, at a set time or when illumination is low in a crosswalk not having a traffic light and may operate traffic lights are a flickering signal in a crosswalk having traffic lights, under the control of the controller 700. Furthermore, the beacon signal receiver 100 may also provide the intensity of a received beacon.

Figure 3:
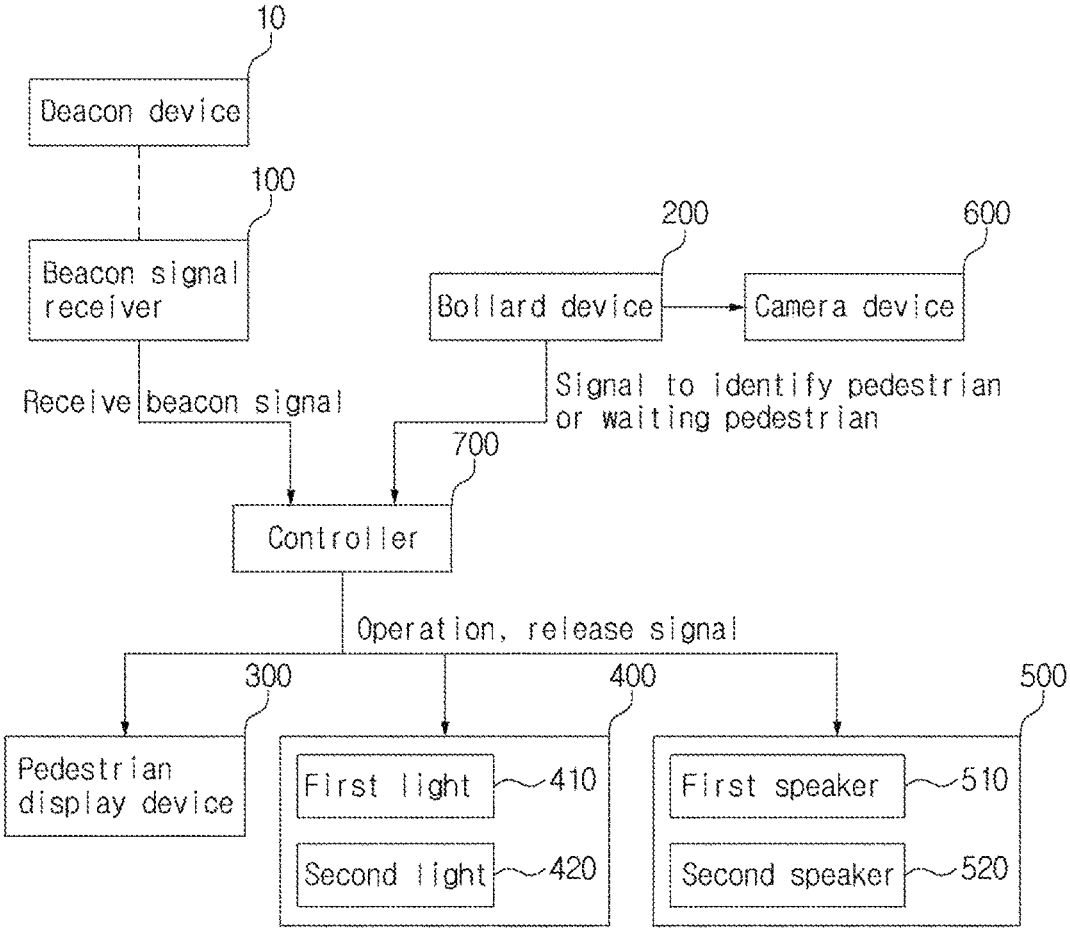
FIG. 3 is a schematic diagram of a bollard device according to an embodiment of the present invention.
Figure 4:
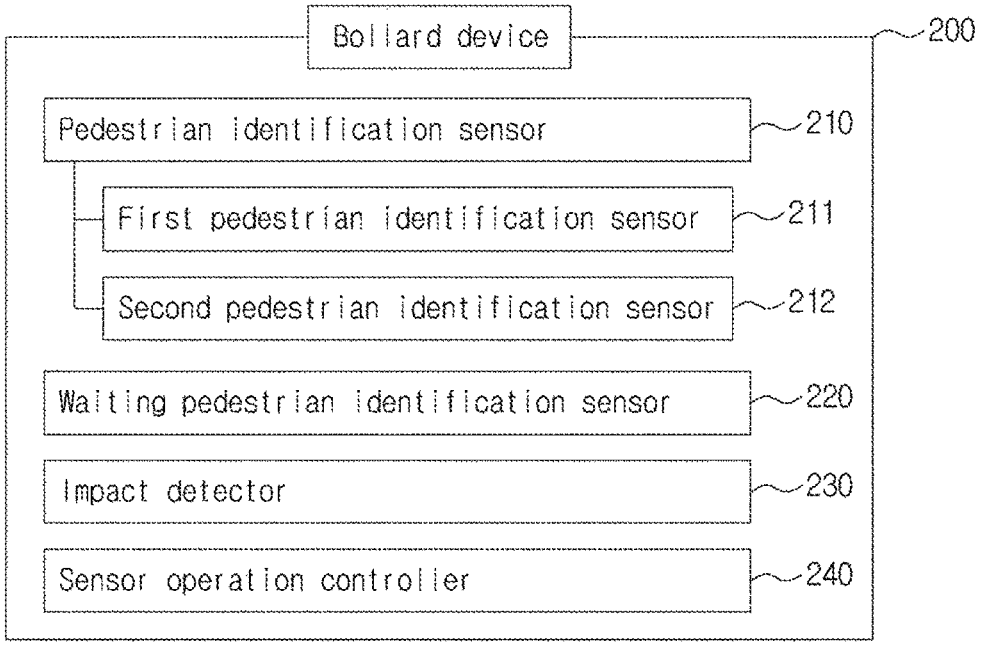
FIG. 4 is a block diagram of a bollard device according to an embodiment of the present invention.

The bollard devices 200 are disposed to face each other and are positioned closer to one side of a crosswalk toward a sidewalk where a person waits to cross the street at the crosswalk. As shown in FIGS. 3 and 4, the bollard device 200 includes a pedestrian identification sensor 210, a waiting pedestrian identification sensor 220, an impact detector 230, and a sensor operation controller 240.

The pedestrian identification sensor 210 is installed on the body of the bollard and detects a pedestrian who walks from a sidewalk toward a crosswalk and a pedestrian who walks from the crosswalk toward a sidewalk. The pedestrian identification sensor 210 includes a first pedestrian identification sensor 211 having a first light-emitting unit and a first light-receiving unit and a second pedestrian identification sensor 212 having a second light-emitting unit and a second light-receiving unit. The second pedestrian identification sensor 212 is horizontally spaced apart from the first pedestrian identification sensor 211. The first and second pedestrian identification sensors 211 and 212 generate first and second sensing signals based on the detection of a pedestrian who moves between the bollard devices 200, and provide the signals to the controller 700. Accordingly, the controller 700 may identify a pedestrian who walks from a sidewalk toward a crosswalk or a pedestrian who walks from the crosswalk to a sidewalk by receiving the first and second sensing signals from the first and second pedestrian identification sensors 211 and 212 of the bollard devices. For example, when the second pedestrian identification sensor 212 detects a second sensing signal after the first pedestrian identification sensor 211 positioned from the bollard device toward a sidewalk detects a first sensing signal, the controller 700 may identify that a pedestrian enters a crosswalk from the sidewalk. Inversely, when the first pedestrian identification sensor 211 detects a first sensing signal after the second pedestrian identification sensor 212 detects a second sensing signal, the controller 700 may identify that a pedestrian enters a sidewalk from a crosswalk.

The waiting pedestrian identification sensor 220 is installed on the body of the bollard device and identify whether a waiting pedestrian is present in a sidewalk adjacent to a crosswalk. An infrared sensor may be used as the waiting pedestrian identification sensor 220.

The impact detector 230 detects an impact applied to the body of the bollard device. The impact detector 230 generates an impact detection signal and provides it to the camera device 600 when the body of the bollard device is inclined at a specific level or more due to an impact and detected by a tilt sensor, or generates an impact detection signal and provides it to the camera device 600 when an impact of a specific level or more is applied to the bollard device.

The sensor operation controller 240 drives the pedestrian identification sensor 210 and the waiting pedestrian identification sensor 220 or stops the operations of the pedestrian identification sensor 210 and the waiting pedestrian identification sensor 220 in response to an operation signal from the controller 700.

The pedestrian display device 300 displays a pedestrian or waiting pedestrian so that a vehicle approaching a crosswalk can identify the pedestrian or the waiting pedestrian. The pedestrian display device 300 may display "PEDESTRIAN CAUTION" using LEDs when a pedestrian who crosses the street at a crosswalk is present and display "PEDESTRIAN WAITING" using LEDs when a waiting pedestrian is present, under the control of the controller 700.

The lighting device 400 brightens a crosswalk or a sidewalk neighboring the crosswalk. The lighting device 400 includes a first light 410 configured to brighten a crosswalk and a second light 420 configured to brighten a sidewalk. When a beacon signal is received and a pedestrian who crosses the street at a crosswalk is present, the first light 410 is driven by the controller 700. When a waiting pedestrian is present, the second light 420 is driven by the controller 700.

The speaker 500 generates a warning sound to a pedestrian or waiting pedestrian when a vehicle enters a crosswalk. The speaker 500 includes a first speaker 510 configured to generate a warning sound with respect to a pedestrian at a crosswalk and a second speaker 520 configured to generate a warning sound with respect to a waiting pedestrian near a crosswalk.

The camera device 600 photographs an image including the bollard device 200 positioned at a sidewalk adjacent to a crosswalk, and stores a photographed image when an impact detection signal is received from the bollard device 200. When an impact is applied to the bollard device 200 due to a vehicle, an assailant vehicle can be identified based on an image stored in the camera device 600.

Figure 5:
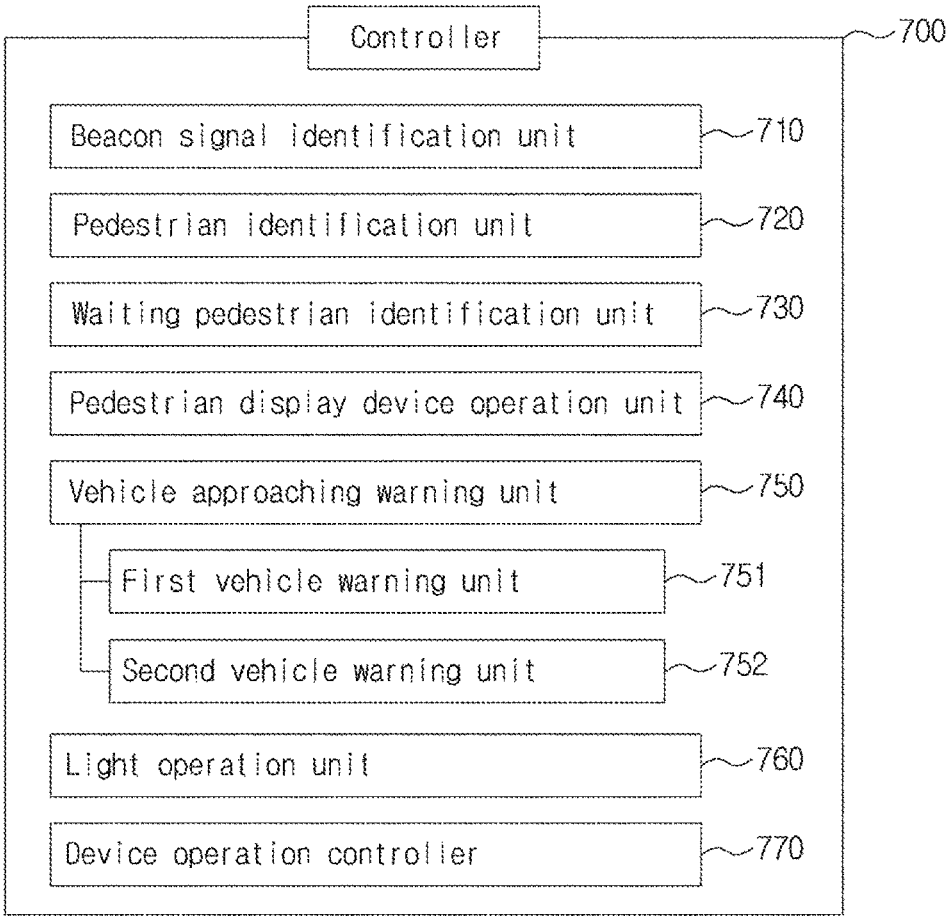
FIG. 5 is a block diagram of a controller according to an embodiment of the present invention.

The controller 700 may be configured in a separate body form, and controls the operations of the beacon signal receiver 100, bollard device 200, pedestrian display device 300, lighting device 400 and speaker 500 while communicating with them or receives sensed signals from them. As shown in FIG. 5, the controller 700 includes a beacon signal identification unit 710, a pedestrian identification unit 720, a waiting pedestrian identification unit 730, a pedestrian display device operation unit 740, a vehicle approaching warning unit 750, a light operation unit 760, and a device operation controller 770.

The beacon signal identification unit 710 receives information about the reception of a beacon signal from the beacon signal receiver 100. Accordingly, when the beacon signal is received, the controller 700 may identify that a vehicle enters a crosswalk at a distance of about 70 m. Furthermore, the controller 700 may identify the location of the vehicle by checking the intensity of the beacon signal.

The pedestrian identification unit 720 identifies whether a pedestrian who crosses the street at a crosswalk by analyzing first and second sensing signals received from the first and second pedestrian identification sensors 211 and 212 of the bollard devices 200. The pedestrian identification unit 720 may determine whether a pedestrian is present within a crosswalk by analyzing first and second sensing signals, sensed by the first pedestrian identification sensor 211 and the second pedestrian identification sensor 212 horizontally installed on bollard devices adjacent to a crosswalk, and pedestrian counting information, and calculating the number of pedestrians who have entered the crosswalk from a sidewalk and the number of pedestrians who have entered the sidewalk from the crosswalk. For example, after a first sensing signal is detected by the first pedestrian identification sensor 211 of a bollard device positioned closer to a sidewalk, when the second pedestrian identification sensor 212 counts the first and second sensing signals while detecting the second sensing signal, the number of pedestrians who have entered a crosswalk from a sidewalk can be identified. Inversely, after a second sensing signal is detected by the second pedestrian identification sensor 212, when the first pedestrian identification sensor 211 counts the first and second sensing signals while detecting the first sensing signal, the number of pedestrians who enter the sidewalk from the crosswalk can be identified.

The waiting pedestrian identification unit 730 identifies whether a waiting pedestrian is present in a sidewalk adjacent to a crosswalk by receiving a sensing signal from the waiting pedestrian identification sensor 220 of the bollard device 200.

When a beacon signal is received and the presence of a pedestrian who crosses the street at a crosswalk or a waiting pedestrian in a sidewalk adjacent to the crosswalk is identified, the pedestrian display device operation unit 740 turns on the pedestrian display device 300 of a lights-out state so that the driver of a vehicle approaching the crosswalk can identify the presence of the pedestrian or waiting pedestrian. Furthermore, when a beacon signal is not received, the pedestrian display device operation unit 740 releases the operation of the turned-on pedestrian display device 300. Accordingly, the vehicle approaching the crosswalk can identify that the pedestrian or the waiting pedestrian is positioned in the crosswalk by checking the turn-on state of the pedestrian display device 300, thereby inducing safe driving. For example, the pedestrian display device 300 may display "PEDESTRIAN WAITING" using LEDs when a waiting pedestrian is positioned in a sidewalk adjacent to a crosswalk. The pedestrian display device 300 may display "PEDESTRIAN CAUTION" using LEDs when a pedestrian who crosses the street at a crosswalk is present.

When a beacon signal is received, the vehicle approaching warning unit 750 notifies a pedestrian or waiting pedestrian of the approaching of a vehicle through the speaker 500. The vehicle approaching warning unit 750 includes a first vehicle warning unit 751 configured to output a voice, warning the approaching of a vehicle, to a pedestrian when a beacon signal is received and the pedestrian is identified to be present at the crosswalk, and a second vehicle warning unit 752 configured to output a voice that cautions against the approaching of a vehicle when a beacon signal is received and a waiting pedestrian is identified to be present in a sidewalk adjacent to a crosswalk. Accordingly, when a pedestrian is not present in a crosswalk and a waiting pedestrian is present in a sidewalk after a vehicle approaching the crosswalk is identified through the beacon signal receiver 100, the second vehicle warning unit 752 may output a caution voice, so the waiting pedestrian can be prevented from entering the crosswalk. When a pedestrian who crosses the street at a crosswalk is present, the first vehicle warning unit 751 may output a warning voice, so the pedestrian can be induced to rapidly move to a sidewalk. For example, when an approaching vehicle is identified and a waiting pedestrian is present in a sidewalk, a voice "VEHICLE IS RAPIDLY APPROACHING. BE CAREFUL" may be output. When a pedestrian who crosses the street at a crosswalk is present, a voice "RAPIDLY MOVE TO SIDEWALK" may be output.

When a beacon signal is received, the light operation unit 760 turns on the lighting device 400 of a lights-out state so that it brightens a pedestrian or a waiting pedestrian. When a beacon signal is received and a pedestrian who crosses the street at a crosswalk is present, the light operation unit 760 drives a first light 410. When a waiting pedestrian is present, the light operation unit 760 drives a second light 420. The driver of a vehicle approaching such a crosswalk can identify whether a pedestrian or a waiting pedestrian is present based on the position of the light.

The device operation controller 770 controls the beacon signal receiver 100 configured to receive a beacon signal from the beacon device 10 of a vehicle and an operation of the bollard device 200 configured to identify a pedestrian or a waiting pedestrian. The device operation controller 770 may control an operation so that it is performed based on sunset, a set time or an illumination criterion in a crosswalk not having a traffic light, and may control an operation so that it is performed when traffic lights for a vehicle is a flickering signal in a crosswalk having traffic lights. The device operation controller 770 provides an operation signal when the beacon signal receiver 100 and/or the bollard device 200 are driven, and provides a release signal when the operations of the beacon signal receiver 100 and/or the bollard device 200 is stopped.

Hereinafter, an operation of a safe crossing management system using the beacon device according to an embodiment of the present invention is described.

First, the beacon signal receiver 100, the pedestrian display device 300, the lighting device 400, the speaker 500, the camera device 600, and the controller 700 are installed on a fixed pillar disposed in a sidewalk adjacent to a crosswalk and extended to the street at the crosswalk in the case of the crosswalk not having a traffic light, and they are installed on a traffic light pillar in the case of a crosswalk having traffic lights. Furthermore, the bollard device 200 configured to detect a pedestrian who enters a crosswalk or a waiting pedestrian waiting at a sidewalk is positioned in a sidewalk at the entrance of a crosswalk.

When a beacon signal generated by the beacon device 10 of a vehicle approaching a crosswalk about 60~70 m ahead is received, the beacon signal receiver 100 provides the received beacon signal to the controller 700. The controller 700 identifies whether a pedestrian who crosses the street at a crosswalk or a waiting pedestrian in a sidewalk adjacent to the crosswalk is present through the bollard device 200. In this case, regarding the presence of a pedestrian, a pedestrian who enters the crosswalk from the sidewalk may be distinguished from a pedestrian who enters the sidewalk from the crosswalk by checking first and second sensing signals received from the first and second pedestrian identification sensors 211 and 212 horizontally installed on the bollard device 200. A waiting pedestrian may be identified by the waiting pedestrian identification sensor 220 positioned from the bollard device toward a sidewalk direction. For example, when the second pedestrian identification sensor 212 detects a second sensing signal after the first pedestrian identification sensor 211 positioned from the bollard device toward a sidewalk direction detects a first sensing signal, it may be identified that a pedestrian enters a crosswalk from the sidewalk. Inversely, when the first pedestrian identification sensor 211 detects a first sensing signal after the second pedestrian identification sensor 212 detects a second sensing signal, it may be identified that a pedestrian enters a sidewalk from a crosswalk.

When a beacon signal is received and the presence of a pedestrian who crosses the street at a crosswalk or a waiting pedestrian in a sidewalk adjacent to the crosswalk is identified, the controller 700 turns on the pedestrian display device 300 of a lights-out state so that the driver of a vehicle approaching the crosswalk can identify the presence of the pedestrian or waiting pedestrian. For example, the pedestrian display device 300 may display "PEDESTRIAN WAITING" using LEDs when a waiting pedestrian is positioned in a sidewalk adjacent to a crosswalk, and may display "PEDESTRIAN CAUTION" using LEDs when a pedestrian who crosses the street at a crosswalk is present.

Furthermore, when a beacon signal is received and the presence of a pedestrian in a crosswalk is identified, the controller 700 generates a voice, warning the approaching of a vehicle, with respect to the pedestrian. When a beacon signal is received and the presence of a waiting pedestrian in a sidewalk adjacent to a crosswalk is identified, the controller 700 generates a voice that cautions against the approaching of a vehicle. For example, a voice "RAPIDLY MOVE TO SIDEWALK" may be generated with respect to the pedestrian. A voice "VEHICLE IS RAPIDLY APPROACHING. BE CAREFUL" may be generated with respect to the waiting pedestrian.

Furthermore, when a beacon signal is received and the presence of a pedestrian in a crosswalk is identified, the controller 700 brightens the crosswalk by driving the first light 410 of the lighting device 400. When a waiting pedestrian is present in a sidewalk, the controller 700 brightens the sidewalk by driving the second light 420.

As described above, in accordance with an embodiment of the present invention, in a crosswalk not having a traffic light or at night when a traffic light does not operate in a crosswalk, a pedestrian who crosses the street at the crosswalk or a waiting pedestrian in a sidewalk adjacent to the crosswalk can identify information about a vehicle approaching the crosswalk about 60~70 m ahead. Accordingly, the pedestrian or the waiting pedestrian can rapidly cross the street at the crosswalk or wait without entering the crosswalk until the vehicle passes through the crosswalk. Furthermore, the driver of a vehicle approaching a crosswalk can pass through the crosswalk while paying attention because he or she can check warning contents for a pedestrian or waiting pedestrian about 60~70 m ahead before the vehicle reaches the crosswalk.

The embodiments of the present invention have advantages in that the distance that a vehicle approaching a crosswalk is recognized can be adjusted because a beacon signal transmitted by the beacon device mounted on the vehicle is received and a pedestrian or waiting pedestrian can be notified of the approaching of a vehicle through a voice or a light because the vehicle approaching a crosswalk can be identified cheaply, rapidly and simply.

Furthermore, there is an advantage in that the driver of a vehicle on which the beacon device has been installed can pass through a crosswalk safely while paying attention because the driver can identify a pedestrian who crosses the street at the crosswalk or a waiting pedestrian near the crosswalk in a safety distance of about 60~70 m before the driver enters the crosswalk.

In particular, the embodiments of the present invention have an advantage in that a pedestrian or waiting pedestrian can be protected in a no-signal crosswalk not having a traffic light or when a traffic light flickers.

As described above, although the present invention has been described in connection with the limited embodiments and drawings, the present invention is not limited to the embodiments and drawings. A person having ordinary skill in the art to which the present invention pertains may modify and change the present invention within the technical spirit of the present invention and the equivalent range of the following claims.

What is claimed is:

1. A pedestrian protection system using a beacon signal, comprising:

a beacon device mounted on a vehicle to transmit the beacon signal;

a beacon signal receiver configured to receive the beacon signal transmitted by the beacon device of the vehicle;

bollard devices disposed adjacent to one side of a crosswalk toward a sidewalk where a person waits to cross a street at the crosswalk in such a way as to face each other and configured to detect a pedestrian who enters the crosswalk or a waiting pedestrian waiting at the sidewalk;

a pedestrian display device configured to display a pedestrian or the waiting pedestrian so that a driver of the vehicle is capable of identifying the pedestrian or waiting pedestrian;

a lighting device configured to brighten the crosswalk or the sidewalk;

a speaker configured to notify the pedestrian or the waiting pedestrian of an approaching of the vehicle; and a controller configured to identify the approaching of the vehicle based on the beacon signal received from the beacon signal receiver, to receive information about the pedestrian or waiting pedestrian from the bollard devices, and to control operations of the pedestrian display device and the lighting device, wherein the bollard devices comprises:

a pedestrian identification sensor configured to comprise a first pedestrian identification sensor having a first light-emitting unit and a first light-receiving unit and a second pedestrian identification sensor having a second light-emitting unit and a second light-receiving unit and horizontally spaced apart from the first pedestrian identification sensor and installed on a body of the bollard devices to detect a pedestrian who enters the crosswalk from the sidewalk and a pedestrian who enters the sidewalk from the crosswalk;

a waiting pedestrian identification sensor installed on the body of the bollard devices to identify whether the waiting pedestrian is present in the sidewalk adjacent to the crosswalk; and a sensor operation controller configured to drive the pedestrian identification sensor and waiting pedestrian identification sensor or stop operations of the pedestrian identification sensor and waiting pedestrian identification sensor in response to an operation signal received from the controller, and wherein the controller comprises:

a beacon signal identification unit configured to receive information about the reception of the beacon signal from the beacon signal receiver;

a pedestrian identification unit configured to receive first and second sensing signals from the first and second pedestrian identification sensors of the bollard devices and to identify whether a pedestrian who crosses the street at the crosswalk by calculating a number of pedestrians who have entered the crosswalk from the sidewalk and a number of pedestrians who have entered the sidewalk from the crosswalk;

a waiting pedestrian identification unit configured to identify whether the waiting pedestrian is present in the sidewalk adjacent to the crosswalk based on a sensing signal received from the waiting pedestrian identification sensor of the bollard devices;

a pedestrian display device operation unit configured to turn on the pedestrian display device of a lights-out state so that the driver of the vehicle approaching the crosswalk is capable of identifying a pedestrian who crosses the street at the crosswalk or the waiting pedestrian in the sidewalk adjacent to the crosswalk when a beacon signal is received and the presence of the pedestrian or waiting pedestrian is identified;

a vehicle approaching warning unit configured to notify the pedestrian or waiting pedestrian of the approaching of the vehicle through the speaker when the beacon signal is received;

a light operation unit configured to turn on the light device of a lights-out state so that the light device brightens the pedestrian or the waiting pedestrian when the beacon signal is received; and a device operation controller configured to provide an operation signal when the beacon signal receiver or the bollard devices is driven and to provide a release signal when an operation of the beacon signal receiver or the bollard devices is stopped.

2. The pedestrian protection system of claim 1, wherein the beacon signal receiver, pedestrian display device, lighting device, speaker, camera device and controller are installed on a fixed pillar disposed in a sidewalk adjacent to a crosswalk and extended to a street at the crosswalk in the crosswalk not having a traffic light, and are installed on a traffic light pillar in a crosswalk having traffic lights.

3. The pedestrian protection system of claim 1, wherein the beacon device has a transmission distance of 60m~70m so that the vehicle is capable of being identified in the crosswalk ahead.

4. The pedestrian protection system of claim 1, further comprising a camera device configured to photograph an image including a bollard device disposed in the sidewalk adjacent to the crosswalk and to store the photographed image when an impact detection signal is received from the bollard device, wherein the bollard device further comprises an impact detector configured to generate the impact detection signal when the body of the bollard device is inclined at a specific level or more due to an impact through a tilt sensor and to provide the impact detection signal to the camera device or configured to generate the impact detection signal when an impact of a specific level or more is applied to the body of the bollard device and to provide the impact detection signal to the camera device.

5. The pedestrian protection system of claim 1, wherein the lighting device comprises:

a first light configured to brighten the crosswalk, and a second light configured to brighten the sidewalk, wherein the light operation unit of the controller turns on the first light when a beacon signal is received and a pedestrian who crosses the street at the crosswalk is present and turns on the second light when the waiting pedestrian is present.

6. The pedestrian protection system of claim 1, wherein: the speaker comprises:

a first speaker configured to generate a warning sound with respect to a pedestrian at the crosswalk, and a second speaker configured to generate a warning sound with respect to the waiting pedestrian near the crosswalk, and the vehicle approaching warning unit of the controller comprises:

a first vehicle warning unit configured to generate a voice, warning the approaching of the vehicle, with respect to a pedestrian when a beacon signal is received and the pedestrian is identified to be present in the crosswalk, and a second vehicle warning unit configured to generate a voice, cautioning against the approaching of the vehicle, with respect to the waiting pedestrian when a beacon signal is received and the waiting pedestrian is identified to be present in the sidewalk adjacent to the crosswalk.

* * * * *